US006194839B1

(12) United States Patent
Chang

(10) Patent No.: US 6,194,839 B1
(45) Date of Patent: Feb. 27, 2001

(54) LATTICE STRUCTURE BASED LED ARRAY FOR ILLUMINATION

(75) Inventor: Chin Chang, Yorktown Heights, NY (US)

(73) Assignee: Philips Electronics North America Corporation, New York, NY (US)

( * ) Notice: Subject to any disclaimer, the term of this patent is extended or adjusted under 35 U.S.C. 154(b) by 0 days.

(21) Appl. No.: 09/431,584

(22) Filed: Nov. 1, 1999

(51) Int. Cl.[7] ..... F21P 1/02

(52) U.S. Cl. ..... 315/185 S; 315/185 R; 362/252; 362/800

(58) Field of Search ..... 315/185 R, 185 S, 315/179, 192, 312, 324, 200 A; 362/800, 252

(56) References Cited

U.S. PATENT DOCUMENTS 3,619,715 * 11/1971 Kim ..... 315/232
4,298,869 11/1981 Okuno ..... 340/782
4,329,625 * 5/1982 Nishizawa et al. ..... 315/192
5,726,535 3/1998 Yan ..... 315/185
5,806,965 * 9/1998 Deese ..... 362/800

* cited by examiner

*Primary Examiner*—David Vu
*Assistant Examiner*—Wilson Lee
(74) *Attorney, Agent, or Firm*—Robert J. Kraus

(57) ABSTRACT

A lighting system comprising a plurality of light-emitting diodes and a current driver for driving current through a plurality of parallel disposed, electrically conductive branches, wherein the branches comprise at least one cell. In each cell, each branch has a light-emitting diode with an anode terminal and a cathode terminal. The anode terminal of each light-emitting diode is coupled to the cathode terminal of a light-emitting diode of an adjacent branch via a shunt. The shunt further comprises a light-emitting diode. In each cell, each light-emitting diode may have a different forward voltage characteristic, while still insuring that all of the light-emitting diodes in the arrangement have the same brightness. Upon failure of one light-emitting diode, the remaining light-emitting diodes in the lighting system are not extinguished.

16 Claims, 3 Drawing Sheets

LATTICE STRUCTURE BASED LED ARRAY FOR ILLUMINATION

CROSS-REFERENCE TO RELATED APPLICATIONS

The subject matter of this application is related to application Ser. No. 09/431,585 filed on Nov. 1, 1999 by the inventor herein and Shaomin Peng for LED ARRAY EMPLOYING A SPECIFIABLE LATTICE RELATIONSHIP.

FIELD OF THE INVENTION

This invention relates generally to lighting systems, and more particularly to an improved array structure for light-emitting diodes used as illumination sources.

BACKGROUND OF THE INVENTION

A light-emitting diode (LED) is a type of semiconductor device, specifically a p-n junction, which emits electromagnetic radiation upon the introduction of current thereto. Typically, a light-emitting diode comprises a semiconducting material that is a suitably chosen gallium-arsenic-phosphorus compound. By varying the ratio of phosphorus to arsenic, the wavelength of the light emitted by a light-emitting diode can be adjusted.

With the advancement of semiconductor materials and optics technology, light-emitting diodes are increasingly being used for illumination purposes. For instance, high brightness light-emitting diodes are currently being used in automotive signals, traffics lights and signs, large area displays, etc. In most of these applications, multiple light-emitting diodes are connected in an array structure so as to produce a high amount of lumens.

FIG. 1 illustrates a typical arrangement of light-emitting diodes 1 through m connected in series. Power supply source 4 delivers a high voltage signal to the light-emitting diodes via resistor $R_1$, which controls the flow of current signal in the diodes. Light-emitting diodes which are connected in this fashion usually lead to a power supply source with a high level of efficiency and a low amount of thermal stresses.

Occasionally, a light-emitting diode may fail. The failure of a light-emitting diode may be either an open-circuit failure or a short-circuit failure. For instance, in short-circuit failure mode, light-emitting diode 2 acts as a short-circuit, allowing current to travel from light-emitting diode 1 to 3 through light-emitting diode 2 without generating a light. On the other hand, in open-circuit failure mode, light-emitting diode 2 acts as an open circuit, and as such causes the entire array illustrated in FIG. 1 to extinguish.

In order to address this situation, other arrangements of light-emitting diodes have been proposed. For instance, FIG. 2(*a*) illustrates another typical arrangement of light-emitting diodes which consists of multiple branches of light-emitting diodes such as 10, 20, 30 and 40 connected in parallel. Each branch comprises light-emitting diodes connected in series. For instance, branch 10 comprises light-emitting diodes 11 through $n_1$ connected in series. Power supply source 14 provides a current signal to the light-emitting diodes via resistor $R_2$.

Light-emitting diodes which are connected in this fashion have a higher level of reliability than light-emitting diodes which are connected according to the arrangement shown in FIG. 1. In open-circuit failure mode, the failure of a light-emitting diode in one branch causes all of the light-emitting diodes in that branch to extinguish, without significantly effecting the light-emitting diodes in the remaining branches. However, the fact that all of the light-emitting diodes in a particular branch are extinguished by an open-circuit failure of a single light-emitting diode is still an undesirable result. In short-circuit failure mode, the failure of a light-emitting diode in a first branch may cause that branch to have a higher current flow, as compared to the other branches. The increased current flow through a single branch may cause it to be illuminated at a different level than the light-emitting diodes in the remaining branches, which is also an undesirable result.

Still other arrangements of light-emitting diodes have been proposed in order to remedy this problem. For instance, FIG. 2(*b*) illustrates another typical arrangement of light-emitting diodes, as employed by a lighting system of the prior art. As in the arrangement shown in FIG. 2(*a*), FIG. 2(*b*) illustrates four branches of light-emitting diodes such as 50, 60, 70 and 80 connected in parallel. Each branch further comprises light-emitting diodes connected in series. For instance, branch 50 comprises light-emitting diodes 51 through $n_5$ connected in series. Power supply source 54 provides current signals to the light-emitting diodes via resistor $R_3$.

The arrangement shown in FIG. 2(*b*) further comprises shunts between adjacent branches of light-emitting diodes. For instance, shunt 55 is connected between light-emitting diodes 51 and 52 of branch 50 and between light-emitting diodes 61 and 62 25 of branch 60. Similarly, shunt 75 is connected between light-emitting diodes 71 and 72 of branch 70 and between light-emitting diodes 81 and 82 of branch 80.

Light-emitting diodes which are connected in this fashion have a still higher level of reliability than light-emitting diodes which are connected according to the arrangements shown in either FIGS. 1 or 2(*a*). This follows because, in an open-circuit failure mode, an entire branch does not extinguish because of the failure of a single light-emitting diode in that branch. Instead, current flows via the shunts to bypass a failed light-emitting diode.

In the short-circuit failure mode, a light-emitting diode which fails has no voltage across it, thereby causing all of the current to flow through the branch having the failed light-emitting diode. For example, if light-emitting diode 51 short circuits, current will flow through the upper branch. Thus, in the arrangement shown in FIG. 2(*b*), when a single light-emitting diode short circuits, the corresponding light-emitting diodes 61, 71 and 81 in each of the other branches are also extinguished.

The arrangement shown in FIG. 2(*b*) also experiences other problems. For instance, in order to insure that all of the light-emitting diodes in the arrangement have the same brightness, the arrangement requires that parallel connected light-emitting diodes have matched forward voltage characteristics. For instance, light-emitting diodes 51, 61, 71 and 81, which are parallel connected, must have tightly matched forward voltage characteristics. Otherwise, the current signal flow through the light-emitting diodes will vary, resulting in the light-emitting diodes having dissimilar brightness.

In order to avoid this problem of varying brightness, the forward voltage characteristics of each light-emitting diode must be tested prior to its usage. In addition, sets of light-emitting diodes with similar voltage characteristics must be binned into tightly grouped sets (i.e.—sets of light-emitting diodes for which the forward voltage characteristics are nearly identical). The tightly grouped sets of light-emitting diodes must then be installed in a light-emitting diode arrangement parallel to each other. This binning process is costly, time-consuming and inefficient.

Therefore, there exists a need for an improved light-emitting diode arrangement which does not suffer from the problems of the prior art, as discussed above.

SUMMARY OF THE INVENTION

In accordance with one embodiment of the present invention, a lighting system comprises a plurality of light-emitting diodes. The lighting system further comprises a current driver for driving a current signal through a plurality of parallel disposed, electrically conductive branches. Each light-emitting diode in one branch together with corresponding light-emitting diodes in the remaining branches define a cell unit. In each cell, the anode terminal of each light-emitting diode in one branch is coupled to the cathode terminal of a corresponding light-emitting diode of an adjacent branch via a shunt. Each shunt further comprises another light-emitting diode. Thus, each cell may comprise two branches, thereby having four light-emitting diodes, or may have more than two branches.

The arrangement of light-emitting diodes according to the present invention enables the use of light-emitting diodes having some different forward voltage characteristics, while still insuring that all of the light-emitting diodes in the arrangement have substantially the same brightness. Advantageously, the lighting system of the present invention is configured such that, upon failure of one light-emitting diode in to a branch, the remaining light-emitting diodes in that branch are not extinguished. In another embodiment, the lighting system comprises at least two cells which are cascading, wherein the cascading cells are successively coupled such that the cathode terminal of each light-emitting diode in a branch is coupled to is an anode terminal of a light-emitting diode of the same branch in a next successive cell.

In a preferred embodiment, each branch of the lighting system includes a current-regulating element, such as a resistor, coupled for example, as the first and the last element in each branch.

BRIEF DESCRIPTION OF THE DRAWINGS

The present invention will be further understood from the following description with reference to the accompanying drawings, in which:

FIG. 2(*b*) illustrates another typical arrangement of light-emitting diodes, as employed by a lighting system of the prior art;

DETAILED DESCRIPTION OF THE INVENTION

Figure 3:
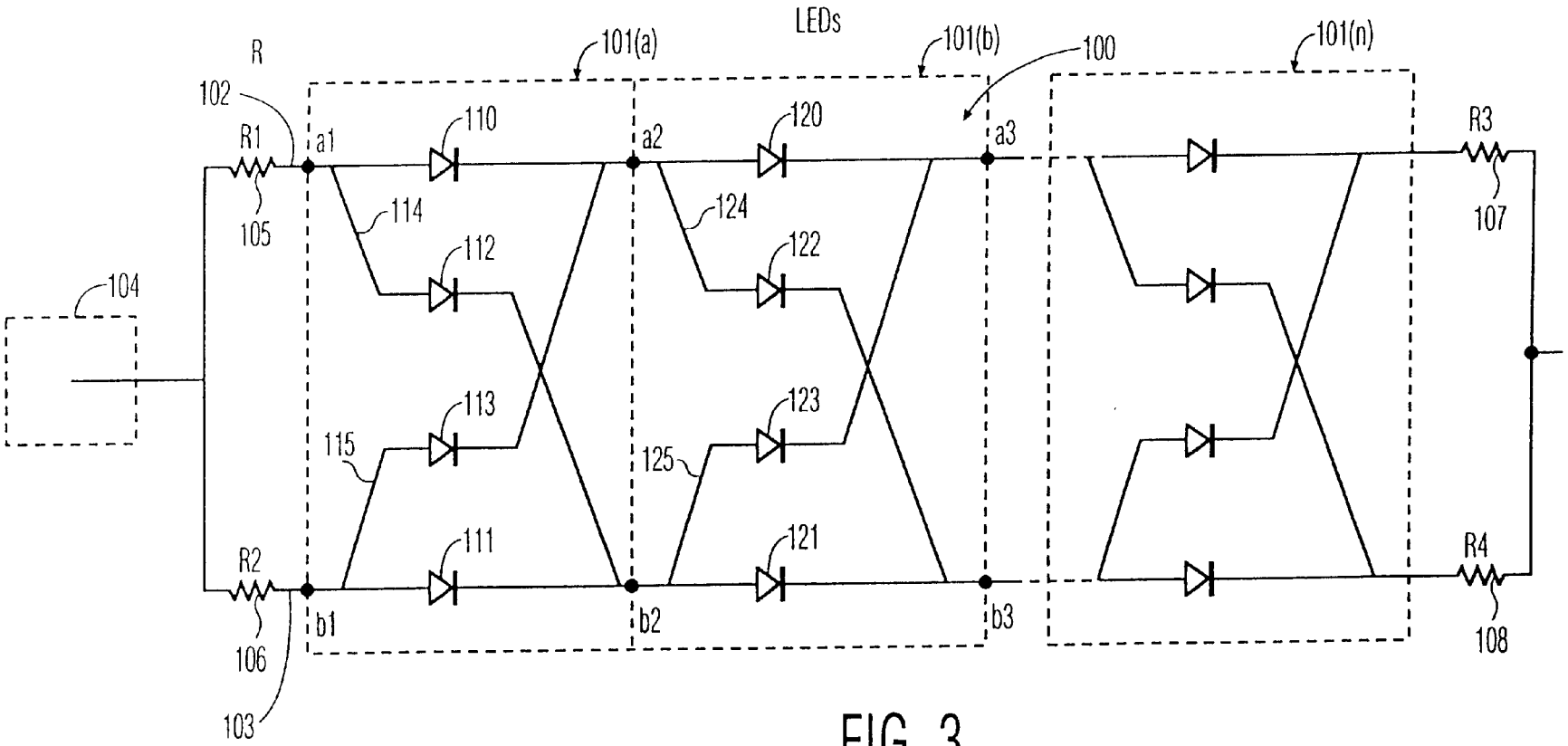
FIG. 3 illustrates an arrangement of light-emitting diodes, as employed by a lighting system, according to one embodiment of the present invention.

FIG. 3 illustrates an arrangement 100 of light-emitting diodes, as employed by a lighting system, according to one embodiment of the present invention. The lighting system comprises a plurality of electrically-conductive branches. Each branch has diodes connected in series. A set of corresponding light-emitting diodes of all branches defines a cell. The arrangement shown in FIG. 3 illustrates cascading cells 101(*a*), 101(*b*) through 101(*n*) of light-emitting diodes. It is noted that, in accordance with various embodiments of the present invention, any number of cells may be formed.

Each cell 101 of arrangement 100 comprises a first light-emitting diode (such as light-emitting diode 110) of branch 102 and a first light-emitting diode (such as light-emitting diode 111) of branch 103. Each of the branches having the light-emitting diodes are initially (i.e.—before the first cell) coupled in parallel via resistors (such as resistors 105 and 106). The resistors preferably have the same resistive values, to insure that an equal amount of current is received via each branch.

The anode terminal of the light-emitting diode in each branch is coupled to the cathode terminal of a corresponding light-emitting diode in an adjacent branch. For example, the anode terminal of light-emitting diode 110 is connected to the cathode terminal of light-emitting diode 111 by a first shunt (such as shunt 114) having a light-emitting diode (such as light-emitting diode 112) connected therein. In addition, the anode terminal of light-emitting diode 111 is connected to the cathode terminal of light-emitting diode 110 by a second shunt (such as shunt 115) having a light-emitting diode (such as light-emitting diode 113) connected therein. Power supply source 104 provides a current signal to the light-emitting diodes via resistors 105 and 106. Additional resistors 107 and 108 are employed in arrangement 100 at the cathode terminals of the last light-emitting diodes in the arrangement shown.

As shown in FIG. 3, branches 102 and 103 have respective input nodes a1 and b1, and nodes a2, a3 and b2, b3 which are respective nodes in each branch between adjoining cells.

Figure 1:
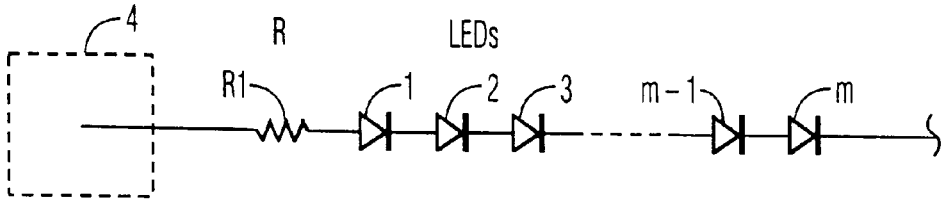
FIG. 1 PRIOR ART
FIG. 1 illustrates a typical arrangement of light-emitting diodes, as employed by a lighting system of the prior art.
Figure 2A:
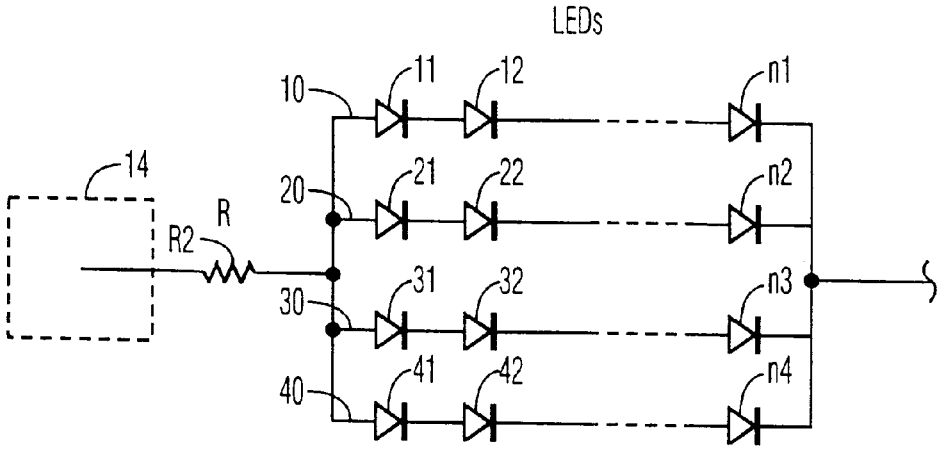
FIG. 2A PRIOR ART
FIG. 2(*a*) illustrates another typical arrangement of light-emitting diodes, as employed by a lighting system of the prior art.
Figure 2B:
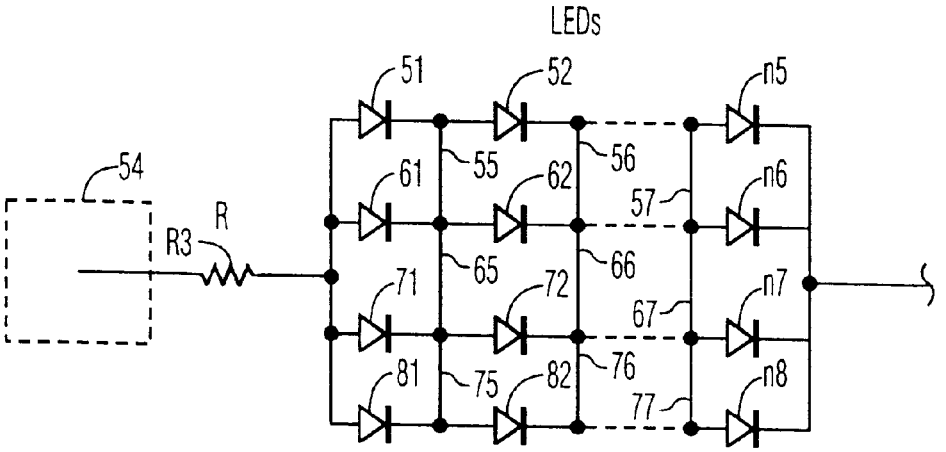
FIG. 2B PRIOR ART

Light-emitting diodes which are connected according to the arrangement shown in FIG. 3 have a higher level of reliability compared to light-emitting diodes which are connected according to the arrangement shown in FIG. 2(*b*). This follows because, in open-circuit failure mode, an entire branch does not extinguish because of the failure of a light-emitting diode in that branch. Instead, current flows via shunts 114 or 115 to bypass a failed light-emitting diode. For instance, if light-emitting diode 110 of FIG. 3 fails, current still flows to (and thereby illuminates) light-emitting diode 120 via lower branch 103 and light-emitting diode 113. In addition, current from the upper branch still flows to the adjacent branch via shunt 114.

Furthermore, in short-circuit failure mode, light-emitting diodes in other branches and shunts do not extinguish because of the failure of a light-emitting diode in one branch. This follows because the light-emitting diodes are not connected in parallel. For example, if light-emitting diode 110 short circuits, current will flow through upper branch 102, which has no voltage drop, and will also flow through light-emitting diode 112 in shunt 114. Light-emitting diode 112 remains illuminated because the current flowing through it drops only a small amount, unlike that which occurs in the arrangement of FIG. 2(*b*). Light-emitting diodes 111 and 113 also remain illuminated because a current flow is maintained through them via branch 103.

In addition, arrangement 100 of light-emitting diodes also alleviates other problems experienced by the light-emitting diode arrangements of the prior art. For instance, light-emitting diode arrangement 100 of the present invention, according to one embodiment, insures that all of the light-emitting diodes in the arrangement have the same brightness without the requirement that the light-emitting diodes have tightly matched forward voltage characteristics. For instance, light-emitting diodes 110, 111, 112 and 113 of the arrangement shown in FIG. 3 may have forward voltage characteristics which are not as tightly matched as the forward voltage characteristics of light-emitting diodes 51, 61, 71 and 81 of the arrangement shown in FIG. 2(*b*). This follows because, unlike the arrangements of the prior art, the light-emitting diodes in cell 101 of arrangement 100 are not parallel-connected to each other.

Because light-emitting diodes in each cell are not parallel-connected, the voltage drop across the diodes does not need to be the same. Therefore, forward voltage characteristics of each light-emitting diode need not be equal to others in order to provide similar amounts of illumination. In other words, the current flow through a light-emitting diode having a lower forward voltage drop will not increase in order to equalize the forward voltage of the light-emitting diode with the higher forward voltage of another light-emitting diode.

Because it is not necessary to have light-emitting diodes with tightly matched forward voltage characteristics, the present invention alleviates the need for binning light-emitting diodes with tightly matched voltage characteristics. Therefore, the present invention reduces the additional manufacturing costs and time which is necessitated by the binning operation of prior art light-emitting diode arrangements.

Figure 4:
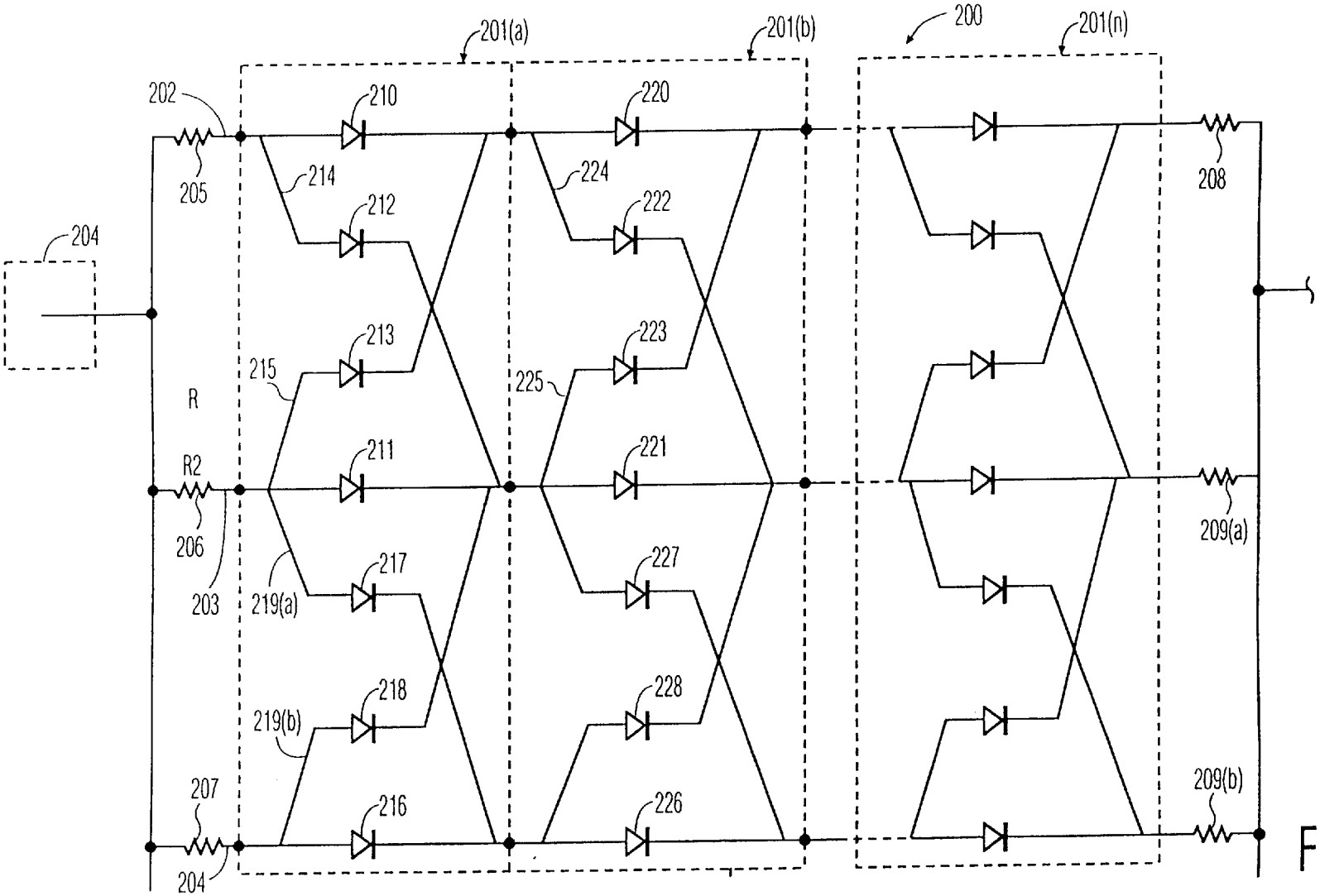
FIG. 4 illustrates an arrangement of light-emitting diodes, as employed by a lighting system, according to another embodiment of the present invention.

It is also noted that the present invention, according to one embodiment thereof, may employ cells having more than two branches. FIG. 4 illustrates an arrangement 200 of light-emitting diodes, as employed by a lighting system, according to another embodiment of the present invention. This lighting system also comprises a plurality of electrically-conductive branches, each having light-emitting diodes connected in series. A set of corresponding light-emitting diodes of all of the branches define a cell unit. The arrangement shown in FIG. 4 illustrates cascading cells 101(*a*), 101(*b*) through 101(*n*) of light-emitting diodes. It is noted that, in accordance with various embodiments of the present invention, any number of cells may be formed.

As shown in FIG. 4, when connected successively, each cell 201 of arrangement 200 comprises a plurality of corresponding light-emitting diodes (such as light-emitting diodes 210, 211 and 216). The branches of the plurality of light-emitting diodes are initially (i.e.—before the first cell) coupled in parallel via current regulating elements such as resistors (e.g.—resistors 205, 206 and 207).

In a preferred embodiment, resistor 205 has the same resistive value as resistor 207, while resistor 208 has the same resistive value as resistor 209(*b*). In addition, resistor 206 advantageously has a resistive value which is two-thirds of the resistive values of either resistors 205 or 207. Similarly, resistor 209(*a*) advantageously has a resistive value which is two-thirds of the resistive values of either resistors 208 or 209(*b*). The lower relative resistive values of resistors 206 and 209(*a*) are due to the fact that they are coupled to branch 203, which provides current to three light-emitting diodes in each cell, while resistors 205 and 208, and resistors 207 and 209(*b*), which are coupled to branches 202 and 204, respectively, provide current to only two light-emitting diodes in each cell.

In addition, the anode terminal of the light-emitting diode in each branch is coupled to the cathode terminal of a corresponding light-emitting diode in an adjacent branch. For instance, the anode terminal of light-emitting diode 210 is connected to the cathode terminal of light-emitting diode 211 by shunt 214. Shunt 214 has light-emitting diode 212 connected therein. In addition, the anode terminal of light-emitting diode 211 is connected to the cathode terminal of light-emitting diode 210 by shunt 215. Shunt 215 has light-emitting diode 213 connected therein.

Furthermore, the anode terminal of light-emitting diode 211 is also connected to the cathode terminal of light-emitting diode 216 by shunt 219(*a*). Shunt 219(*a*) has light-emitting diode 217 connected therein. In addition, the anode terminal of light-emitting diode 216 is connected to the cathode terminal of light-emitting diode 211 by shunt 219(*b*). Shunt 219(*b*) has light-emitting diode 218 connected therein. Power supply source 204 provides current to the light-emitting diodes via resistors 205, 206 and 207. Additional resistors 208, 209(*a*) and 209(*b*) are employed in arrangement 200 at the cathode terminals of the last light-emitting diodes in the arrangement.

Light-emitting diodes which are connected according to the arrangement shown in FIG. 4 also have a high level of reliability. In open-circuit failure mode, no other light-emitting diodes in a branch are extinguished upon the failure of a light-emitting diode in that branch. Instead, current flows via shunts 214 or 215, or via shunts 219(*a*) or 219(*b*), to bypass a failed light-emitting diode, and the remaining light-emitting diodes in the same cell, as well as the remaining light-emitting diodes in the adjacent cascading cells, are not extinguished. For instance, if light-emitting diode 211 of FIG. 4 fails, current still flows to (and thereby illuminates) light-emitting diode 221 via shunts 214 and 218. In addition, current still flows to the light-emitting diodes of the adjacent branches.

Furthermore, in short-circuit failure mode, no other light-emitting diodes in a cell are extinguished when any light-emitting diode short circuits. Current continues to flow through each of the other light-emittting diodes in the cell. For instance, if light-emitting diode 211 short circuits, current will flow through upper branch 203, which has no voltage drop, and will also flow through light-emitting diodes 213 and 217 in shunts 215 and 219(*a*). Light-emitting diode 112 remains illuminated because the current flowing through it drops only a small amount, unlike that which occurs in the arrangement of FIG. 2(*b*). Light-emitting diodes 210, 212, 216 and 218 also remain illuminated because a current flow is maintained through them via branches 202 and 204.

The light-emitting diode arrangement shown in FIG. 4, as previously discussed in connection with the light-emitting diode arrangement shown in FIG. 3, also reduces the requirement that the light-emitting diodes have tightly matched forward voltage characteristics. For instance, the light-emitting diodes in cell 201 of arrangement 200, specifically light-emitting diodes 210 through 218, are not parallel-connected to each other such as to cause the current flow through an light-emitting diode having a lower forward voltage to increase in order to equalize the forward voltage of the light-emitting diode with the higher forward voltage of another light-emitting diode. Again, the present invention reduces the additional manufacturing costs and time which is necessitated by the binning operation of prior art light-emitting diode arrangements.

While there has been shown and described particular embodiments of the invention, it will be obvious to those skilled in the art that changes and modifications can be made therein without departing from the invention, and therefore, the appended claims shall be understood to cover all such changes and modifications as fall within the true spirit and scope of the invention.

What is claimed is:

1. A lighting system comprising:

a power supply source;

a plurality of electrically-conductive branches, said branches coupled in parallel to said power supply source, each of said branches comprising at least one light-emitting diode; and a plurality of shunts, wherein each one of said shunts couples an anode terminal of a respective first light-emitting diode in one of said branches directly to a cathode terminal of a corresponding light-emitting diode in an adjacent one of said branches, such that a corresponding set of light-emitting diodes together with their corresponding coupling shunts define a lattice-connected cell, and wherein said system comprises at least two said cells, and said branches along with said shunts are coupled to form a cascaded-cell lattice arrangement having a respective node in each branch between adjoining cells.

2. The lighting system according to claim 1, wherein said shunts comprise a light-emitting diode.

3. The lighting system according to claim 1, wherein each said branch further comprises a current regulating element.

4. The lighting system according to claim 3, wherein said current regulating element is a respective resistor.

5. The lighting system according to claim 4, wherein each said branch comprises a series of elements, and for each said branch, said respective resistor is a first element of the series.

6. The lighting system according to claim 1, wherein each said branch comprises a series of elements, and for each said branch, said respective resistor is a last element of the series.

7. The lighting system according to claim 1, wherein light-emitting diodes of each one of said cells have different forward voltage characteristics.

8. A method of lighting comprising the steps of:

coupling in parallel a plurality of electrically-conductive branches;

with said branches, forming at least two cascaded cells having a respective node in each branch between adjoining cells, wherein in each said cell, each said branch has a light-emitting diode having an anode terminal and a cathode terminal;

within each cell, coupling the anode terminal of each said light-emitting diode directly to the cathode terminal of a light-emitting diode of an adjacent branch via a shunt; and providing power to said branches via a power supply.

9. The method according to claim 8, wherein said method further comprises the step of coupling in each said shunt a light-emitting diode.

10. The method according to claim 8, wherein said method further comprises the step of coupling in each branch a current regulating element.

11. The method according to claim 10, wherein said step of coupling in each branch a current regulating element comprises coupling in each branch a respective resistor.

12. The method according to claim 11, wherein said step of coupling in each branch a respective resistor comprises forming each branch as a series of elements, and further comprises coupling said respective resistor as a first element in each said branch.

13. The method according to claim 11, wherein said step of coupling in each branch a respective resistor comprises forming each branch as a series of elements, and further comprises coupling said respective resistor as a first element in each said branch.

14. The method according to claim 8, wherein light-emitting diodes of each one of said cells are coupled so as to have different forward voltage characteristics.

15. The method according to claim 11, wherein said plurality of electrically-conductive branches comprises at least three branches, and the step of coupling via a shunt comprises connecting four respective said shunts to at least one of said nodes, two of said four respective said shunts being in one of said adjoining cells, and the other two of said four respective said shunts being in the other adjoining cell.

16. The lighting system according to claim 1, wherein said system comprises three said branches, and at least one of said nodes having four respective said shunts connected thereto, two of said four respective said shunts being in one of said adjoining cells, and the other two of said four respective said shunts being in the other adjoining cell.

* * * * *